US012502574B2

(12) United States Patent
Smith et al.

(10) Patent No.: US 12,502,574 B2
(45) Date of Patent: Dec. 23, 2025

(54) EXERCISE DEVICE

(71) Applicant: iFIT Inc., Logan, UT (US)

(72) Inventors: Kent M. Smith, Nibley, UT (US); Gaylen Ercanbrack, Logan, UT (US); David Hays, Hyde Park, UT (US); Scott Watterson, Providence, UT (US); Timothee Merlu, Vermand (FR); Claude Ceard, Velaux (FR)

( * ) Notice: Subject to any disclaimer, the term of this patent is extended or adjusted under 35 U.S.C. 154(b) by 216 days.

(21) Appl. No.: 18/117,263

(22) Filed: Mar. 3, 2023

(65) Prior Publication Data

US 2023/0277892 A1 Sep. 7, 2023

Related U.S. Application Data

(60) Provisional application No. 63/319,695, filed on Mar. 14, 2022, provisional application No. 63/316,890, filed on Mar. 4, 2022.

(51) Int. Cl.
*A63B 21/00* (2006.01)

(52) U.S. Cl.
CPC ..... *A63B 21/4035* (2015.10); *A63B 21/154* (2013.01); *A63B 2225/12* (2013.01)

(58) Field of Classification Search
CPC ..... A63B 21/154; A63B 21/4035; A63B 2225/12
See application file for complete search history.

(56) References Cited

U.S. PATENT DOCUMENTS 3,123,646 A 3/1964 Easton
3,579,339 A 5/1971 Chang et al.
4,023,795 A 5/1977 Pauls
4,300,760 A 11/1981 Bobroff
D286,311 S 10/1986 Martinell et al.
4,681,318 A 7/1987 Lay
4,684,126 A 8/1987 Dalebout et al.
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet et al.
(Continued)

FOREIGN PATENT DOCUMENTS

CN 110769902 A * 2/2020 ..... A63B 21/0058
KR 20210097651 A * 8/2021
WO WO-2023250464 A2 * 12/2023

OTHER PUBLICATIONS

U.S. Appl. No. 17/066,485, filed Oct. 9, 2020, Weston et al.
(Continued)

*Primary Examiner* — Joshua T Kennedy
(74) *Attorney, Agent, or Firm* — Holland & Hart LLP

(57) ABSTRACT

An exercise device includes a frame and a mirrored surface connected to the frame. A display is disposed within the frame and is positioned such that the display is viewable through at least a portion of the mirrored surface. The exercise device includes one or more arms rotatably attached to the frame and one or more arm motors configured to position the arms relative to the frame. One or more pull cables extend from the one or more arms, and a resistance mechanism including a motor is configured to resist movement of the pull cables.

7 Claims, 9 Drawing Sheets

(56) References Cited

U.S. PATENT DOCUMENTS 4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.

(56) References Cited

U.S. PATENT DOCUMENTS 5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,488,612 B2 * 12/2002 Sechrest ..... A63B 21/152
482/138
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.

(56) References Cited

U.S. PATENT DOCUMENTS

| | | | |
|---|---|---|---|
| D659,777 | S | 5/2012 | Watterson et al. |
| D660,383 | S | 5/2012 | Watterson et al. |
| D664,613 | S | 7/2012 | Dalebout et al. |
| 8,251,874 | B2 | 8/2012 | Ashby et al. |
| 8,298,123 | B2 | 10/2012 | Hickman |
| 8,298,125 | B2 | 10/2012 | Colledge et al. |
| D671,177 | S | 11/2012 | Sip |
| D671,178 | S | 11/2012 | Sip |
| D673,626 | S | 1/2013 | Olson et al. |
| 8,690,735 | B2 | 4/2014 | Watterson et al. |
| D707,763 | S | 6/2014 | Cutler |
| 8,740,753 | B2 | 6/2014 | Olson et al. |
| 8,758,201 | B2 | 6/2014 | Ashby et al. |
| 8,771,153 | B2 | 7/2014 | Dalebout et al. |
| 8,784,270 | B2 | 7/2014 | Ashby et al. |
| 8,808,148 | B2 | 8/2014 | Watterson et al. |
| 8,814,762 | B2 | 8/2014 | Butler et al. |
| D712,493 | S | 9/2014 | Ercanbrack et al. |
| 8,840,075 | B2 | 9/2014 | Dalebout et al. |
| 8,845,493 | B2 | 9/2014 | Watterson et al. |
| 8,870,726 | B2 | 10/2014 | Watterson et al. |
| 8,876,668 | B2 | 11/2014 | Hendrickson et al. |
| 8,894,549 | B2 | 11/2014 | Colledge |
| 8,894,555 | B2 | 11/2014 | Colledge et al. |
| 8,911,330 | B2 | 12/2014 | Watterson et al. |
| 8,920,288 | B2 | 12/2014 | Dalebout et al. |
| 8,986,165 | B2 | 3/2015 | Ashby |
| 8,992,364 | B2 | 3/2015 | Law et al. |
| 8,992,387 | B2 | 3/2015 | Watterson et al. |
| D726,476 | S | 4/2015 | Ercanbrack |
| 9,028,368 | B2 | 5/2015 | Ashby et al. |
| 9,028,370 | B2 | 5/2015 | Watterson et al. |
| 9,039,578 | B2 | 5/2015 | Dalebout |
| D731,011 | S | 6/2015 | Buchanan |
| 9,072,930 | B2 | 7/2015 | Ashby et al. |
| 9,119,983 | B2 | 9/2015 | Rhea |
| 9,123,317 | B2 | 9/2015 | Watterson et al. |
| 9,126,071 | B2 | 9/2015 | Smith |
| 9,126,072 | B2 | 9/2015 | Watterson |
| 9,138,615 | B2 | 9/2015 | Olson et al. |
| 9,142,139 | B2 | 9/2015 | Watterson et al. |
| 9,144,703 | B2 | 9/2015 | Dalebout et al. |
| 9,149,683 | B2 | 10/2015 | Watterson et al. |
| 9,186,535 | B2 | 11/2015 | Ercanbrack |
| 9,186,549 | B2 | 11/2015 | Watterson et al. |
| 9,254,409 | B2 | 2/2016 | Dalebout et al. |
| 9,254,416 | B2 | 2/2016 | Ashby |
| 9,278,248 | B2 | 3/2016 | Tyger et al. |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson et al. |
| 9,352,186 | B2 | 5/2016 | Watterson |
| 9,375,605 | B2 | 6/2016 | Tyger et al. |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,047 | B2 | 8/2016 | Olson et al. |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,276 | B2 | 4/2017 | Dalebout et al. |
| 9,616,278 | B2 | 4/2017 | Olson |
| 9,623,281 | B2 | 4/2017 | Hendrickson et al. |
| 9,636,567 | B2 | 5/2017 | Brammer et al. |
| 9,675,839 | B2 | 6/2017 | Dalebout et al. |
| 9,682,307 | B2 | 6/2017 | Dalebout |
| 9,694,234 | B2 | 7/2017 | Dalebout et al. |
| 9,694,242 | B2 | 7/2017 | Ashby et al. |
| 9,737,755 | B2 | 8/2017 | Dalebout |
| 9,757,605 | B2 | 9/2017 | Olson et al. |
| 9,764,186 | B2 | 9/2017 | Dalebout et al. |
| 9,767,785 | B2 | 9/2017 | Ashby et al. |
| 9,795,822 | B2 | 10/2017 | Smith et al. |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,379 | B2 | 4/2018 | Mortensen et al. |
| 9,943,719 | B2 | 4/2018 | Smith et al. |
| 9,943,722 | B2 | 4/2018 | Dalebout |
| 9,948,037 | B2 | 4/2018 | Ashby |
| 9,968,816 | B2 | 5/2018 | Olson et al. |
| 9,968,821 | B2 | 5/2018 | Finlayson et al. |
| 9,968,823 | B2 | 5/2018 | Cutler |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack et al. |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson et al. |
| 10,207,143 | B2 | 2/2019 | Dalebout et al. |
| 10,207,145 | B2 | 2/2019 | Tyger et al. |
| 10,207,147 | B2 | 2/2019 | Ercanbrack et al. |
| 10,207,148 | B2 | 2/2019 | Powell et al. |
| 10,212,994 | B2 | 2/2019 | Watterson et al. |
| 10,220,259 | B2 | 3/2019 | Brammer |
| 10,226,396 | B2 | 3/2019 | Ashby |
| 10,226,664 | B2 | 3/2019 | Dalebout et al. |
| 10,252,109 | B2 | 4/2019 | Watterson |
| 10,258,828 | B2 | 4/2019 | Dalebout et al. |
| 10,272,317 | B2 | 4/2019 | Watterson |
| 10,279,212 | B2 | 5/2019 | Dalebout et al. |
| 10,293,211 | B2 | 5/2019 | Watterson et al. |
| D852,292 | S | 6/2019 | Cutler |
| 10,343,017 | B2 | 7/2019 | Jackson |
| 10,376,736 | B2 | 8/2019 | Powell et al. |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby et al. |
| 10,441,840 | B2 | 10/2019 | Dalebout |
| 10,441,844 | B2 | 10/2019 | Powell |
| 10,449,416 | B2 | 10/2019 | Dalebout et al. |
| 10,471,299 | B2 | 11/2019 | Powell |
| D868,909 | S | 12/2019 | Cutler et al. |
| 10,492,519 | B2 | 12/2019 | Capell et al. |
| 10,493,349 | B2 | 12/2019 | Watterson |
| 10,500,473 | B2 | 12/2019 | Watterson |
| 10,537,764 | B2 | 1/2020 | Smith et al. |
| 10,543,395 | B2 | 1/2020 | Powell et al. |
| 10,561,877 | B2 | 2/2020 | Workman |
| 10,561,893 | B2 | 2/2020 | Chatterton et al. |

(56) References Cited

U.S. PATENT DOCUMENTS 10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
11,938,365 B1* 3/2024 Dorsey ..... A63B 21/00065
2003/0045406 A1* 3/2003 Stone ..... A63B 23/035 482/102
2008/0051256 A1 2/2008 Ashby et al.
2009/0036277 A1* 2/2009 Ish, III ..... A63B 21/153 482/94
2014/0162854 A1* 6/2014 Watterson ..... A63B 21/4035 482/138
2015/0182780 A1* 7/2015 Olson ..... A63B 21/4029 482/92
2015/0251055 A1 9/2015 Ashby
2016/0058335 A1 3/2016 Ashby
2016/0101322 A1* 4/2016 Potter ..... A63B 21/153 482/6
2016/0346595 A1 12/2016 Dalebout et al.
2017/0124912 A1 5/2017 Ashby et al.
2017/0193578 A1 7/2017 Watterson
2017/0266489 A1 9/2017 Douglass et al.
2017/0270820 A1 9/2017 Ashby et al.
2018/0085630 A1 3/2018 Capell et al.
2018/0099116 A1 4/2018 Ashby
2018/0099180 A1 4/2018 Wilkinson
2018/0111034 A1 4/2018 Watterson
2019/0223612 A1 7/2019 Watterson et al.
2019/0269971 A1 9/2019 Capell et al.
2020/0009417 A1 1/2020 Dalebout
2020/0014967 A1* 1/2020 Putnam ..... G06F 3/16
2020/0047054 A1* 2/2020 Ward ..... G16H 40/67
2020/0047055 A1* 2/2020 Ward ..... G06V 10/143
2020/0139187 A1* 5/2020 Kennington ..... A63B 71/0622
2020/0368575 A1 11/2020 Hays et al.
2020/0391069 A1 12/2020 Olson et al.
2021/0001177 A1 1/2021 Smith
2021/0038937 A1* 2/2021 Orady ..... A63B 23/03541
2021/0046353 A1 2/2021 Dalebout et al.
2021/0106899 A1 4/2021 Willardson et al.
2021/0110910 A1 4/2021 Ostler et al.
2021/0128978 A1* 5/2021 Gilstrom ..... A63B 21/4027
2021/0146221 A1 5/2021 Dalebout et al.
2021/0213331 A1 7/2021 Watterson
2021/0236874 A1* 8/2021 Ward ..... A63B 24/0087
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0062685 A1 3/2022 Ashby et al.
2022/0104992 A1 4/2022 Ashby
2022/0118301 A1* 4/2022 Valente ..... A63B 21/154
2022/0134210 A1* 5/2022 Popescu ..... A63B 71/0622 482/1
2022/0212052 A1 7/2022 Ercanbrack et al.
2022/0212055 A1* 7/2022 Valente ..... A63B 24/0021
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0273985 A1* 9/2022 Jeong ..... A63B 22/0076
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0370854 A1* 11/2022 Zhang ..... A63B 21/169
2022/0395729 A1 12/2022 Toth
2023/0039903 A1 2/2023 Brammer et al.
2023/0054845 A1 2/2023 Smith
2023/0116715 A1* 4/2023 Powell ..... A63B 21/00072 482/110
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson
2023/0310922 A1* 10/2023 Kang ..... A63B 21/156 482/94
2024/0024751 A1* 1/2024 Azaria ..... A63B 24/0075

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.

(56) References Cited

OTHER PUBLICATIONS

U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Aug. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.
U.S. Appl. No. 63/316,890, filed Mar. 4, 2022, Smith et al.

* cited by examiner

EXERCISE DEVICE

CROSS-REFERENCE TO RELATED PATENT APPLICATIONS

This application claims the benefit and priority to U.S. Provisional Patent Application No. 63/316,890 filed Mar. 4, 2022, and U.S. Provisional Patent Application No. 63/319,695 filed Mar. 14, 2022, which applications are incorporated herein by reference in their entireties for all they disclose.

BACKGROUND

Physical exercise has many benefits, but exercise equipment for different exercises may take up a large volume of space. Furthermore, it may be difficult for some exercisers to know what to do. Even with a wide array of exercise equipment, it may be difficult to know how to configure the exercise equipment to perform various exercises. Exercise equipment may also be difficult to configure, resulting in dangerous use of the exercise equipment.

SUMMARY

One implementation of the present disclosure is an exercise device including a frame with a mirrored surface connected to the frame. A display is disposed within the frame. And positioned such that the display is viewable through at least a portion of the mirrored surface. The exercise device includes one or more arms rotatably attached to the frame, one or more arm motors configured to position the arms relative to the frame. The exercise device includes one or more pull cables extending from the one or more arms, and a resistance mechanism including a motor configured to resist movement of the pull cables.

In some embodiments, the mirrored surface includes a first portion and a second portion, and the display is positioned such that it is viewable through the first portion.

In some embodiments, the one or more arms are rotatably attached to the frame.

In some embodiments, the one or more arms are configured to rotate about a horizontal axis.

In some embodiments, the one or more arms are configured to rotate about a vertical axis.

In some embodiments, the one or more arms are configured to translate vertically with respect to the frame.

In some embodiments, the exercise device includes one or more worm drives. The one or more arm motors, in some embodiments, are operably coupled to the one or more arms using the one or more worm drives.

In some embodiments, the one or more worm drives include one or more double enveloping worm gears.

In some embodiments, the exercise device includes one or more cycloidal drives. The one or more arm motors, in some embodiments, are operably coupled to the one or more arms using the one or more cycloidal drives.

In some embodiments, the exercise device includes one or more harmonic drives. The one or more arm motors, in some embodiments, are operably coupled to the one or more arms using the one or more harmonic drives.

In some embodiments, the exercise device includes mechanical limit switches configured to halt movement of the one or more arms.

In some embodiments, the one or more arm motors are configured to calibrate the movement of the one or more arms by rotating the one or more arms 180 degrees such that the arms engage one or more mechanical stops.

In some embodiments, the motor is configured to vibrate the one or more pull cables.

In some embodiments, the motor is configured to selectively provide concentric and eccentric force.

In some embodiments, the exercise device includes one or more sensors operably coupled to the motor. The one or more sensors, in some embodiments, are configured to determine a rotation of the motor.

In some embodiments, the one or more sensors are encoders.

In some embodiments, the motor is configured to maintain a constant tension on the one or more pull cables.

In some embodiments, the resistance mechanism includes a traveling carriage. One or more upper pulleys of the carriage, in some embodiments, are operably connected to one or more ropes. One or more lower pulleys of the carriage, in some embodiments, are operably connected to one or more cables.

In some embodiments, the one or more pull cables comprise one or more ropes.

In some embodiments, the one or more pull cables are disposed within the one or more arms.

One implementation of the present disclosure is a method including rotating one or more arms of an exercise device to a first position. The exercise device queries a user of the exercise device at a display of the exercise device whether a position of the one or more arms corresponds to an expected position of the one or more arms. The position of the one or more arms is determined not to correspond to an expected position of the one or more arms based on determining that an amount of time has passed without receiving user input or based on receiving user input indicating that the position of the one or more arms does not correspond to the expected position of the one or more arms. The method includes beginning a calibration of the one or more arms.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

The present disclosure relates to exercise equipment. Typically, exercise equipment that can be used for a variety of exercises or types of exercises is adjusted or configured for the particular exercise. Often this requires the user of the exercise equipment to adjust, change, modify, move, add, and/or remove one or more components of the exercise equipment to achieve the correct configuration. One or more embodiments of exercise equipment as described herein may allow a user to perform a wide variety of exercises without having to configure the exercise equipment. For example, the exercise device may have one or more arms that may move and/or configure themselves, ensuring a correct (e.g., a desired) configuration of the exercise device with little or no input from a user. In another example, the exercise device may present a workout to the user and configure the arms of the exercise device in accordance with the workout. This may allow the user to rest between different exercises and may provide a more engaging workout experience. In this way, the self-configuring exercise device of the present disclosure may represent a significant safety improvement over conventional exercise equipment by eliminating the possibility of an incorrect or dangerous configuration, such as through user error. One or more embodiments of a self-configuring exercise device of the present disclosure may provide an improved user experience when compared to conventional exercise equipment by removing or reducing the need for the user to configure the exercise equipment.

Figure 1:
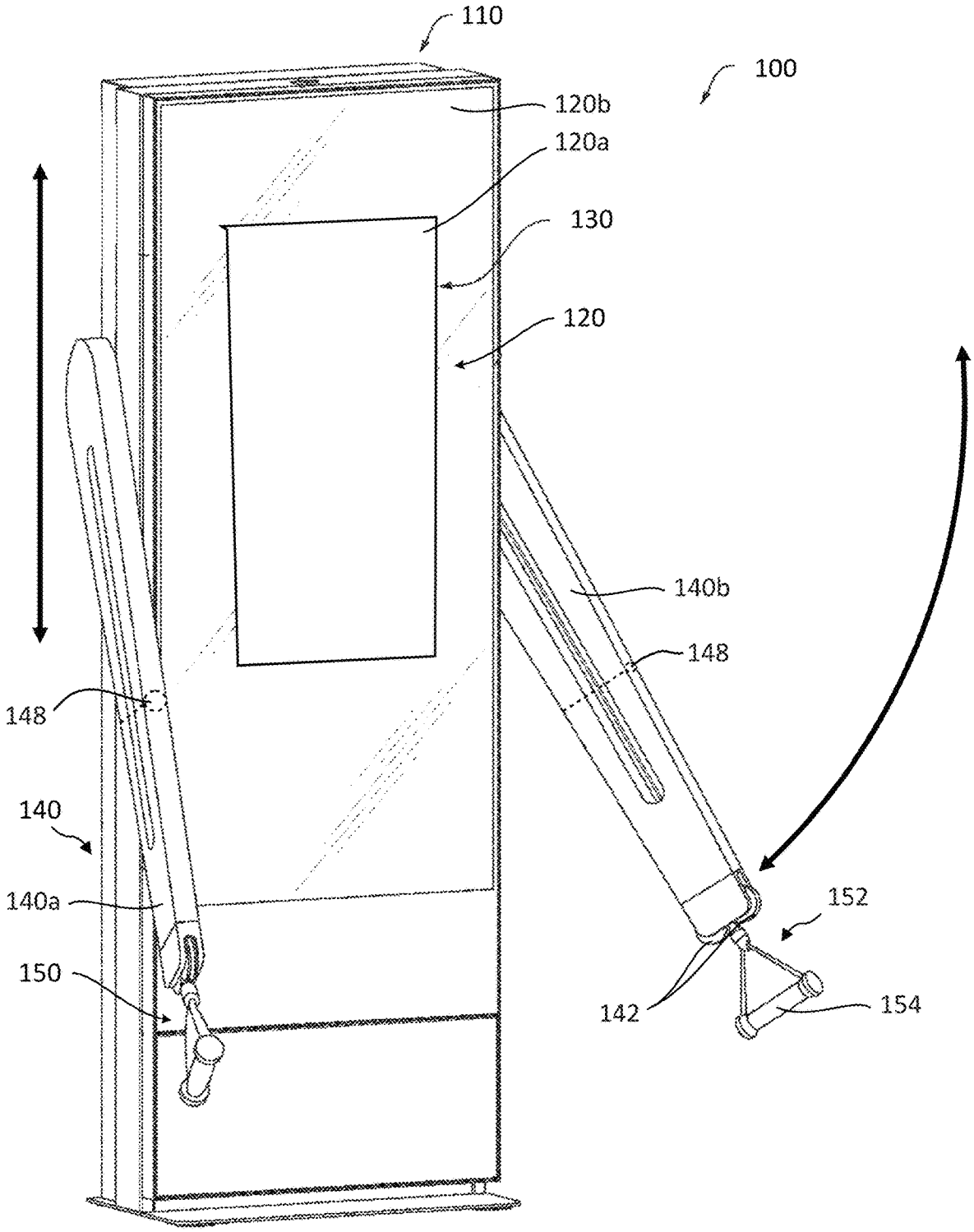
FIG. 1 is a perspective view an exercise device, according to one embodiment of the present disclosure.

FIG. 1 illustrates an exercise device 100, according to one embodiment of the present disclosure. The exercise device 100 includes a frame 110, one or more arms 140 connected to the frame 110, and one or more pull cables 150 operatively connected to at least one of the arms 140. In some embodiments, the exercise device 100 includes a mirrored surface 120 connected to the frame. For example, the mirrored surface 120 may be positioned on an exterior of the frame 110. In another example, the mirrored surface 120 may allow a user to view themselves while exercising. In some embodiments, this helps the user to one or more of examine, critique, and correct their form, which, in at least one embodiment, will help reduce injury, improve muscle strength, improve flexibility, and combinations thereof.

In some embodiments, the mirrored surface 120 includes a first portion 120*a* and a second portion 120*b*. In some embodiments, the first portion 120*a* extends over a display 130. For example, the first portion 120*a* may be at least partially transparent, and the display 130 may be disposed behind the first portion 120*a* such that the display 130 may be visible through the first portion 120*a*. In some embodiments, the first portion 120*a* is an inner portion of the mirrored surface 120 or defines an inner area of the mirrored surface 120. For example, an area defined by the first portion 120*a* may be located within or encompassed by an area defined by the second portion 120*b*. Put another way, the second portion 120*b* may surround the first portion 120*a*. In some embodiments, the second portion 120*b* may surround the display 130.

In some embodiments, the display 130 is a backlit display to facilitate viewing the display 130 through the first portion 120*a*. The backlit display may be a monitor, a television, or other backlit display. In some embodiments, the first portion 120*a* is indistinguishable from the second portion 120*b* when the backlit display is turned off, and an image originating from the backlit display becomes visible through the first portion 120*a* when the backlit display is turned on. The display 130 may be a touchscreen display such that a user may interact with the display 130 through a touch input. For example, a user may interact with the display to provide input associated with an exercise and/or workout program (e.g., respond to queries) without the need to locate and/or use a remote and/or a mobile device.

In some embodiments, the mirrored surface 120 is a one-way mirror. For example, the display 130 may show a workout program that may be viewable through the mirrored surface 120, and a reflection may simultaneously be viewable on one or more portions of the mirrored surface 120. In this manner, the user may view themselves on the mirrored surface 120 while also viewing the display 130. Thus, the user may perform exercises instructed by a workout program on the display 130, and simultaneously compare their execution of the exercises seen in the mirrored surface to the instruction shown on the workout program. The capability to both view the display and view a reflection in the mirrored surface may improve the user experience. Viewing both the display and a reflection may assist the user to improve their exercise form, and/or allow the user to more effectively perform exercises.

As discussed herein, the exercise device 100 includes one or more arms 140. In some embodiments, the one or more arms 140 are rotatably attached to the frame 110. For example, each of the arms 140 may be configured to rotate about a substantially horizontal axis such that a distal end of each of the one or more arms 140 rises relative to the frame 110 as illustrated in FIG. 1. In another example, each of the arms 140 is configured to rotate about a substantially vertical axis such that a distal end of the arms 140 moves laterally relative to the frame 110, as will be discussed in detail in connection with FIGS. 2A-2D. In yet another example, each of the one or more arms 140 is configured to both rotate about a substantially horizontal axis and rotate about a substantially vertical axis. In this way, the arms 140 may be rotatable relative to the frame 110 and positionable in 3-dimensional space.

As discussed herein, the exercise device 100 includes one or more pull cables 150. The pull cables 150 may be made of rope, metal, metal encased in rubber or plastic, and combinations thereof. Each of the one or more pull cables 150 may include a handle 152 configured to be grasped by a user. The handle 152 may be disposed at the distal end of each of the one or more arms 140. The handle may include a cover 154 that at least partially surrounds a portion of the handle 152. The cover 154 may be a soft material such as foam or rubber. The handle 152 including the cover 154 may rotate freely. For example, the handle 152 may rotate independent of the arms 140.

In some embodiments, the one or more pull cables 150 are disposed inside of the one or more arms 140 such that each of the one or more pull cables 150 extend from a distal end of each of the one or more arms 140. For example, when not in use, the handle 152 may extend from the arms 140, and the pull cables 150 may be contained at least partially within the arms 140. During exercise, the handle 152 may be pulled by a user, thereby pulling a portion of the pull cables 150 out of the arms 140.

In some embodiments, the distal end of each of the one or more arms 140 includes two or more pulleys 142. For example, the pulleys 142 may be located adjacent and in a single plane. The pulleys 142 may each have a groove at least as deep as half the thickness or diameter of the one or more pull cables 150. The pulleys 142 may be spaced such that a pull cable of the one or more pull cables 150 may be contained therebetween (e.g., may not escape), but such that the pull cable may be pulled through or along the pulleys 142. In this way, the pull cables 150 may be pulled in two or more directions and remain in contact with at least one of the pulleys 142. The pull cables 150 may therefore be pulled in any direction to facilitate a wide variety of exercises. As will be discussed herein, the pull cables 150 may be operably coupled to a resistance device, such as a resistance motor to provide a resistance to a user performing an exercise.

In some embodiments, the arms 140 include a first arm 140*a* and a second arm 140*b*. The first arm 140*a* and the second arm 140*b* may be located on opposite sides of the frame 110. In some embodiments, the first arm 140*a* and the second arm 140*b* are angled outwards, or laterally away from the frame 110. For example, the first arm 140*a* and the second arm 140*b* may each be attached to the frame 110 at a proximate end of the arm, and a distal end of the first arm 140*a* and the second arm 140*b* may each extend laterally away from the frame 110. In this way as the arms 140 are raised relative to the frame 110 (e.g., rotated about a vertical axis), a distance may increase between a distal end of the first arm 140*a* and a distal end of the second arm 140*b*. This may allow for greater flexibility of exercises which may be performed using the exercise device. This may also provide greater room for performing exercises using the exercise device.

In some embodiments, the one or more arms 140 are operably connected to one or more arm motors. The one or more arm motors may be configured to perform one or more of the following: raise, lower, rotate, and move the arms 140 relative to the frame 110. For example, each of the one or more arm motors may be configured to rotate one of the arms 140 about a horizontal axis, a vertical axis, or both. In some embodiments, the arm motors rotate the arms 140 through a path about an axis. In some embodiments, the path is a 180° path. For example, the arms 140 may be positionable in a first position, such as with the distal ends of the arms 140 pointing vertically downwards, and the arm motors may lift and/or rotate the arms 140 to a second position, such as with the distal ends of the arms 140 pointing horizontally upwards. In some embodiments, the first position and the second position define an angle of 180° therebetween. In another example, the arms 140 may be positionable in a third position, such as with the distal ends of the arms 140 pointing in a horizontally forward direction (e.g., in a direction toward a user of the exercise device), and the arm motors may lift and/or rotate the arms 140 to a fourth position, such as with the distal ends of the arms 140 pointing in a horizontally backward direction (e.g., in a direction away from the user). In some embodiments, the third position and the fourth position define an angle of 180° therebetween. In the above example, it should be understood that the arms 140 may be positionable in any intermediate position or angle, for example, between the first and second positions, and/or between the third and fourth positions. In some embodiments, the axes of rotation about which the arms 140 rotate is located at or proximate a point of connection between the arm 140 and the frame 110. Additionally, the limits or extents of the rotation of the arms 140 about the horizontal and/or vertical axes may not be limited to the example described above. In other words, the limits or extents of the rotation of the arms 140 may be any angle relative to the frame in order to provide the self-configuring exercise device as described herein. For example, the arms 140 may rotate horizontally forward (e.g., toward the user) past a parallel configuration. The arms 140 may rotate forward such that the distal ends of the arms 140 meet or touch, or such that the distal ends of the arms 140 are substantially adjacent. In another example, the arms 140 may rotate vertically upwards past a parallel configuration. The arms 140 may rotate upward such that the distal ends of the arms 140 meet or touch, or such that the distal ends of the arms 140 are substantially adjacent. In this way, the movement of the arms may facilitate any number of exercises with the arms 140 positioned at any number of angles and/or positions.

In some embodiments, the arms 140 may each include an optional elbow 148 or a hinge to facilitate bending of the arms 140. For example, the arms 140 may bend about the elbow 148 in order to become more compact for storage of the exercise device when not in use. In another example, the arms 140 may bend about the elbow 148 in order to facilitate further configurations of the exercise device. The distal ends of the arms 140 may be positioned closer to or farther away from the frame 110 based on a bending of the arms 140 about the elbow 148. In some embodiments, the arm motors are configured to bend the arms 140 about the elbow 148. This may be in addition to the arm motors rotating and/or positioning the arms as discussed above. In some embodiments, one or more additionally motors that are not the arm motors bend the arms 140 about the elbows 148. For example, in addition to the distal ends of the arms 140 being positionable about a rotational path relating to the rotation of the arms 140 as discussed above, the arms 140 may bend about the elbow 148 in order to position the distal end at a point in 3-dimensional space. For example, the movement of the distal ends of the arms 140 based on the rotation of the arms 140 as discussed above may define a portion of a sphere (e.g., a partial sphere or a hemisphere), and the bending of the arms 140 about the elbow 148 may facilitate positioning the distal end of the arms 140 at any point within or inside the portion of the sphere. In this way, the arms 140 may be further configurable to provide an optimal positioning of the arms 140 for a particular exercise.

In some embodiments, one or more of the arms 140 is positionable by the arm motors independently of another of the arms 140. For example, the first arm 140*a* may be positioned horizontally forward, and the second arm may be positioned vertically downward. In some embodiments, the arms 140 may be movable together such that each of the arms 140 is positioned as a mirror image of another of the arms 140.

FIG. 2A-2D are top views of the exercise device 100 of FIG. 1 with the arms 140 in various positions. As discussed herein, the arms 140 may rotate about a substantially vertical axis. For example, the arms 140 may rotate such that a distal end of each of the arms 140 travels along a horizontal path, or in a horizontal plane relative to the frame 110. The vertical axis of rotation may correspond to a point of connection between the arms 140 and the frame 110. The one or more arms 140 may rotate together or separately.

Figure 2A:
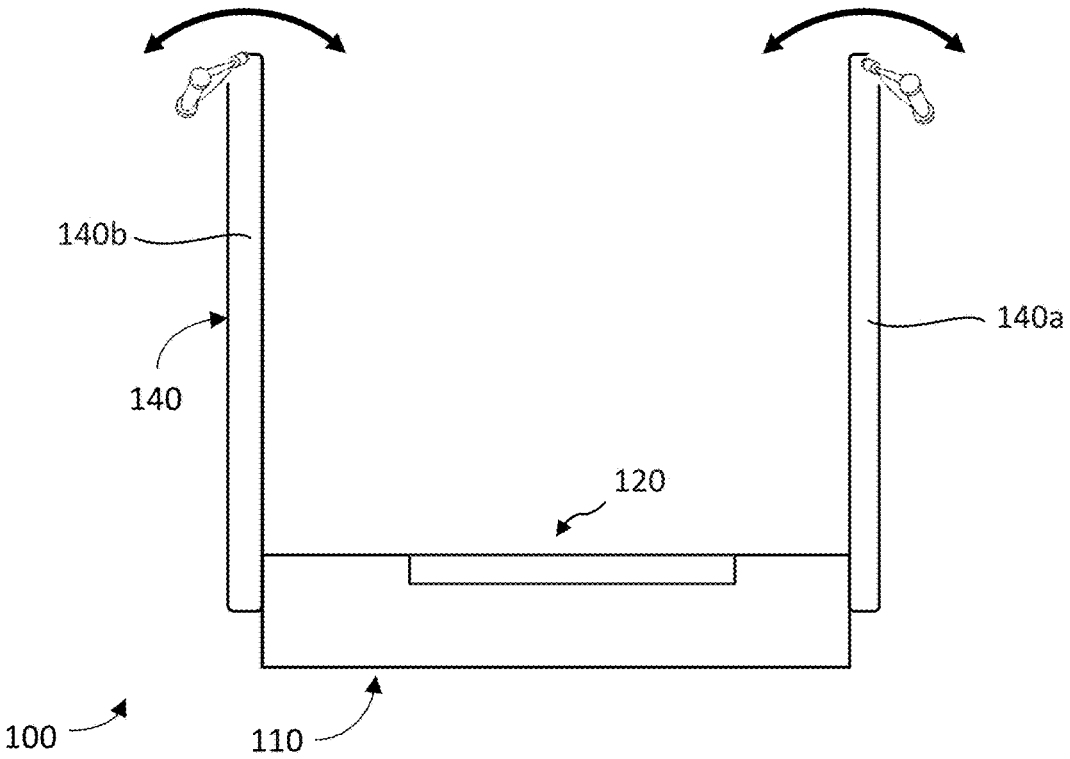
FIGS. 2A-2D are top views of the exercise device of FIG. 1.
Figure 2B:
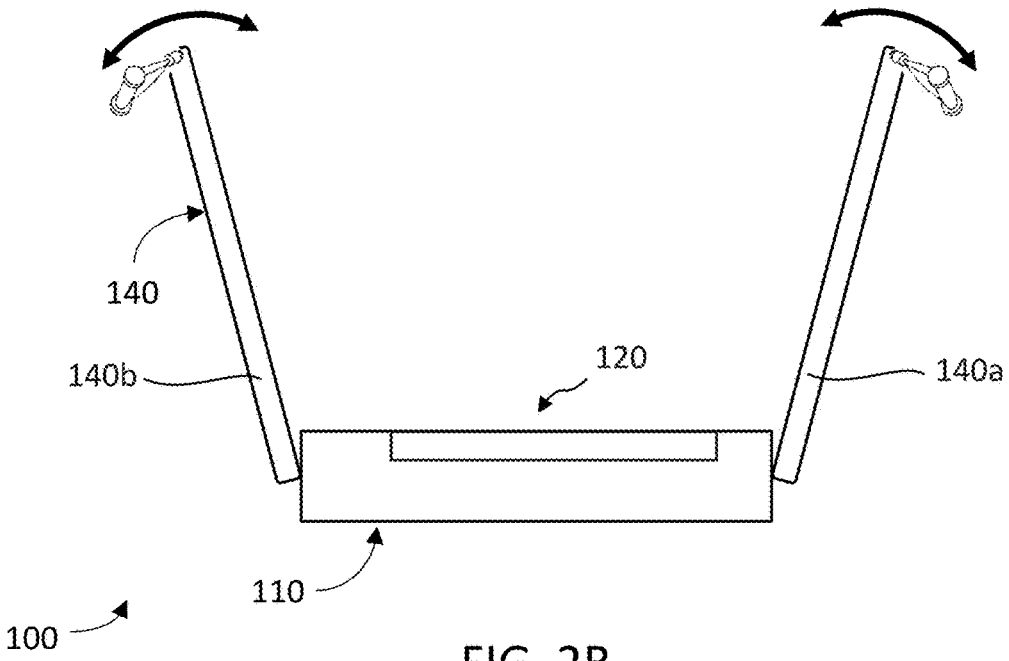
Figure 2C:
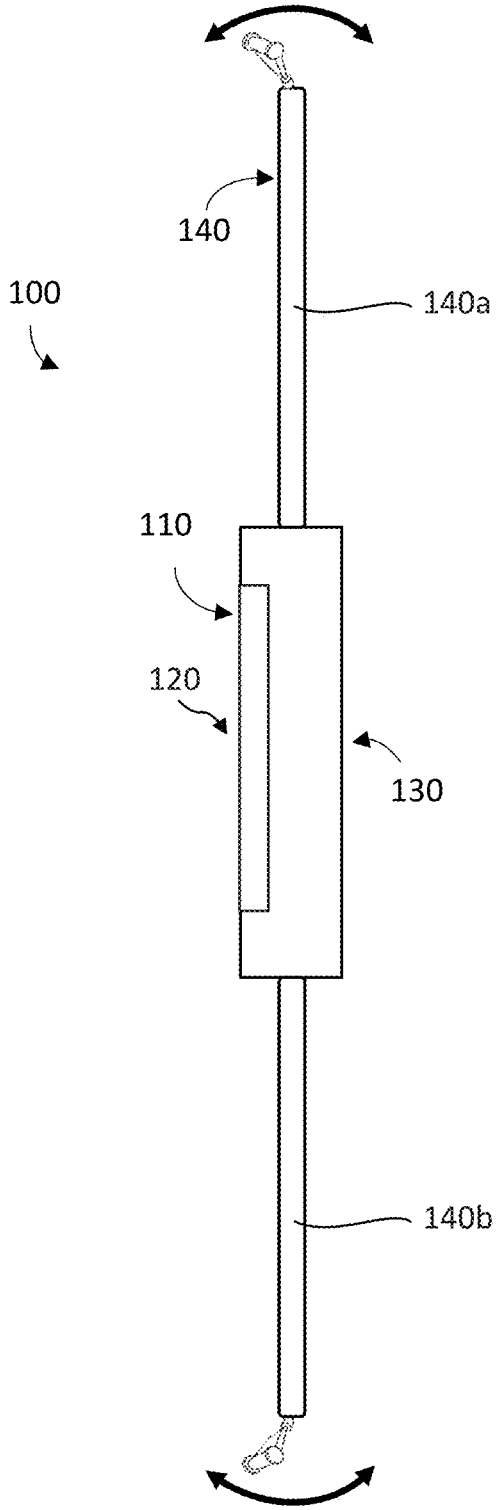
Figure 2D:
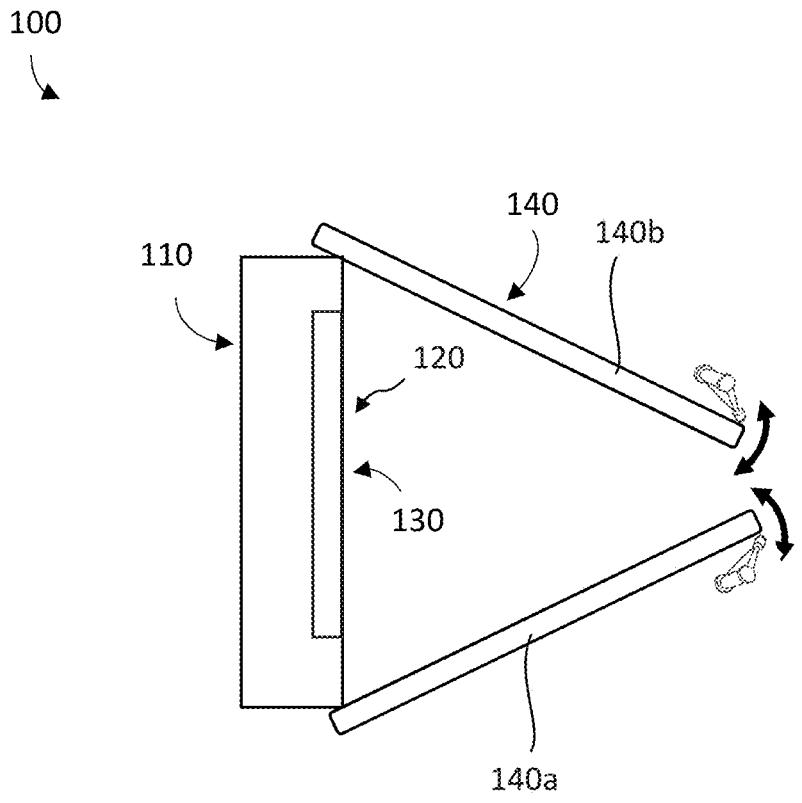

In some embodiments, the one or more arm motors position the one or more arms 140 such that the display 130 is visible. For example, the arm motor may position the arms in a particular configuration (e.g., for a specific workout) in such a way that the user may view the display 130 while interacting with the arms 140, such as through exercise. In some embodiments, the arm motors may position the arms 140 such that they extend forward toward the user and are parallel (e.g., as illustrated in FIG. 2A). In some embodiments, the arm motors position the arms 140 such that they extend forward past a parallel position. For example, as shown in FIG. 2D, the arms 140 may rotate around a vertical axis such that the distal ends of the first arm 140*a* and the second arm 140*b* are proximate or adjacent. This may correspond to the arms 140 occupying a space that is immediately in front of the display 130. This may facilitate one or more exercises that the user may perform.

In some embodiments, the arm motors include one or more gear drives. In some embodiments the one or more gear drives may be worm drives. The worm drives may include one or more worm gears. The one or more worm gears may be double enveloping and/or globoid. In some embodiments the one or more gear drives are cycloidal drives. In some embodiments, the one or more gear drives are harmonic drives. The use of worm drives, cycloidal drives, and/or harmonic drives may help to reduce or eliminate back-driving. In this way, the arms 140 may remain substantially fixed in a position once moved by the arm motor.

In some embodiments, the one or more arm motors include mechanical stops corresponding to a limit or maximum extent in the rotational path or throw of the arms 140. For example, the mechanical stops may prevent the arm motor from rotating the one or more arms 140 further than 180°. In another example, the mechanical stops may prevent the arm motor from rotating one or more of the arms 140 past a point in relation to another of the arms 140, such as past a point where the arms 140 may contact. In some embodiments, each of the one or more arm motors has two mechanical stops to restrict movement of the one or more arms 140 to an arc in front of the display 130. For example, one of the mechanical stops may correspond to an arm position of 0°. One of the mechanical stops may correspond to an arm position of 180°. In some embodiments, the mechanical stops are used to calibrate the one or more arm motors. For example, a user (or the arm motors) may rotate the one or more arms 140 in a first direction until their motion is halted by a first mechanical stop, and then may proceed to rotate the one or more arms 140 in a second (e.g., opposite) direction until their motion is halted by a second mechanical stop. In this way, the one or more arm motors may be configured to calibrate the movement of the one or more arms 140 by rotating the one or more arms 180° such that the arms 140 engage the one or more mechanical stops.

In some embodiments the one or more arm motors include one or more limit switches which may prevent the one or more arm motors from rotating the one or more arms 140 past a predefined point. The one or more limit switches may be used to calibrate the one or more arm motors. For example, the arm motors may rotate the one or more arms 140 in a first direction until their motion is halted by a first limit switch and may then rotate the one or more arms in a second (e.g., opposite) direction until their motion is halted by a second limit switch. In this way, the one or more arm motors may be configured to calibrate the movement of the one or more arms 140 by rotating the one or more arms 180° such that the arm motors engage the one or more limit switches. In this way the exercise device 100 may calibrate a rotational limit of the arms 140.

In some embodiments, the one or more arms 140 are slidably attached to the frame 110. For example, the arms 140 may slide or translate in a vertical direction relative to the frame. In some embodiments, a proximate end of each of the one or more arms 140 is slidably attached to the frame 110. For example, the arms 140 may be slidably attached to the frame 110 substantially at an axis of rotation of the arms 140 such that the one or more arms 140 may slide or translate vertically independent of a rotation of the arms 140. In some embodiments, the arms 140 slide and rotate simultaneously. In some embodiments, the arms 140 rotate at any vertical position of the arms relative to the frame. In some embodiments, the arms translate or slide at any rotational position of the arms 140 relative to the frame.

In some embodiments, the frame 110 includes one or more rails to facilitate the sliding action of the arms 140. In some embodiments, the rails are substantially vertical. In some embodiments, the one or more arms 140 are slidably attached to the rails and configured to translate vertically along a length of the rails. For example, the rails may each have a first (e.g., top) end and a second (e.g., bottom) end. The arms 140 may be slidably attached to the rails and positionable at a first position proximate the first end, a second position proximate the second end, or any position therebetween. In some embodiments, each of the arms 140 is positionable at the same height or at different heights relative to another of the arms 140. For example, each of the arms 140 may be positionable along a length of the rails at the same vertical position, or at different vertical positions. In some embodiments, the length of the rails may span an entire length (e.g., height) of the frame 110. In some embodiments, the length of the rails may span a partial length of the frame 110. In this way, the arms 140 may slide or translate relative to the frame to facilitate configuration of the exercise device for various exercises and/or users, such as users of varying heights. Additionally changing the height of one or more of the arms 140 may alter the direction from which the one or more cables 150 are pulled by a user, which may alter a direction in which resistance is applied to the motion of a user. This may facilitate the user exercising through various forms, directions, angles, and/or workout programs.

In some embodiments, the one or more arms 140 are configured in a slidable configuration and/or a fixed configuration. For example, in the slidable configuration, the arms 140 may slide along the rails, as described herein. In the fixed configuration, the arms 140 may be substantially fixed in place relative to the rails, or may be fixed with respect to movement along the rails in the vertical direction. In some embodiments, the arms 140 may be fixed in the fixed configuration by a gripping mechanism. For example, the gripping mechanism may grip the rails and prevent the arms 140 from sliding along the rails, thereby fixing the arms 140 in place. In some embodiments, the gripping mechanism partially fixes the arms 140 in place. For example, the gripping mechanism may allow an upward motion of the arms, but not a downward motion. In some embodiments, the gripping mechanism includes a release that allows for downwards motion, or that configures the arms 140 in the slidable configuration.

In some embodiments, the arms 140 engage with the frame 110 through one or more rack and pinion gears. For example, a pinion gear of an arm of the arms 140 may engage with a rack gear of the frame 110 as the arm translates relative to the frame. This may ensure a smooth operation of the sliding feature. In some embodiments, the rack and pinion gear facilitates the sliding movement of the arms. For example, the pinion gear may be driven to translate along the rack gear such that the arms 140 may slide relative to the frame 110. In some embodiments, the rack and pinion may prevent the arms from moving vertically. For example, the pinion gear may have a fixed, or non-rotating configuration, and may engage the rack gear to prevent a relative motion of the arms 140.

In some embodiments, the sliding motion of the arms 140 relative to the frame 110 may be driven, such as by a motor. For example, the motor may be operatively coupled to a pinion gear of a rack and pinion gear, such as that discussed above. The motor may drive the pinion gear to travel along the rack gear and thereby adjust a height of an arm of the arms 140 relative to the frame 110. In some embodiments, each of the one or more arms 140 is attached to a belt or chain. The belt or chain may be driven by the motor, thereby raising or lowering an arm of the arms 140. In some embodiments, the motor is the arm motor discussed above. In some embodiments, the motor is one or more additional motors that is not the arm motor. In this way, the arms may be further adjusted automatically by the exercise device 100 to ensure proper and safe configuring of the exercise device 100.

Figure 3A:
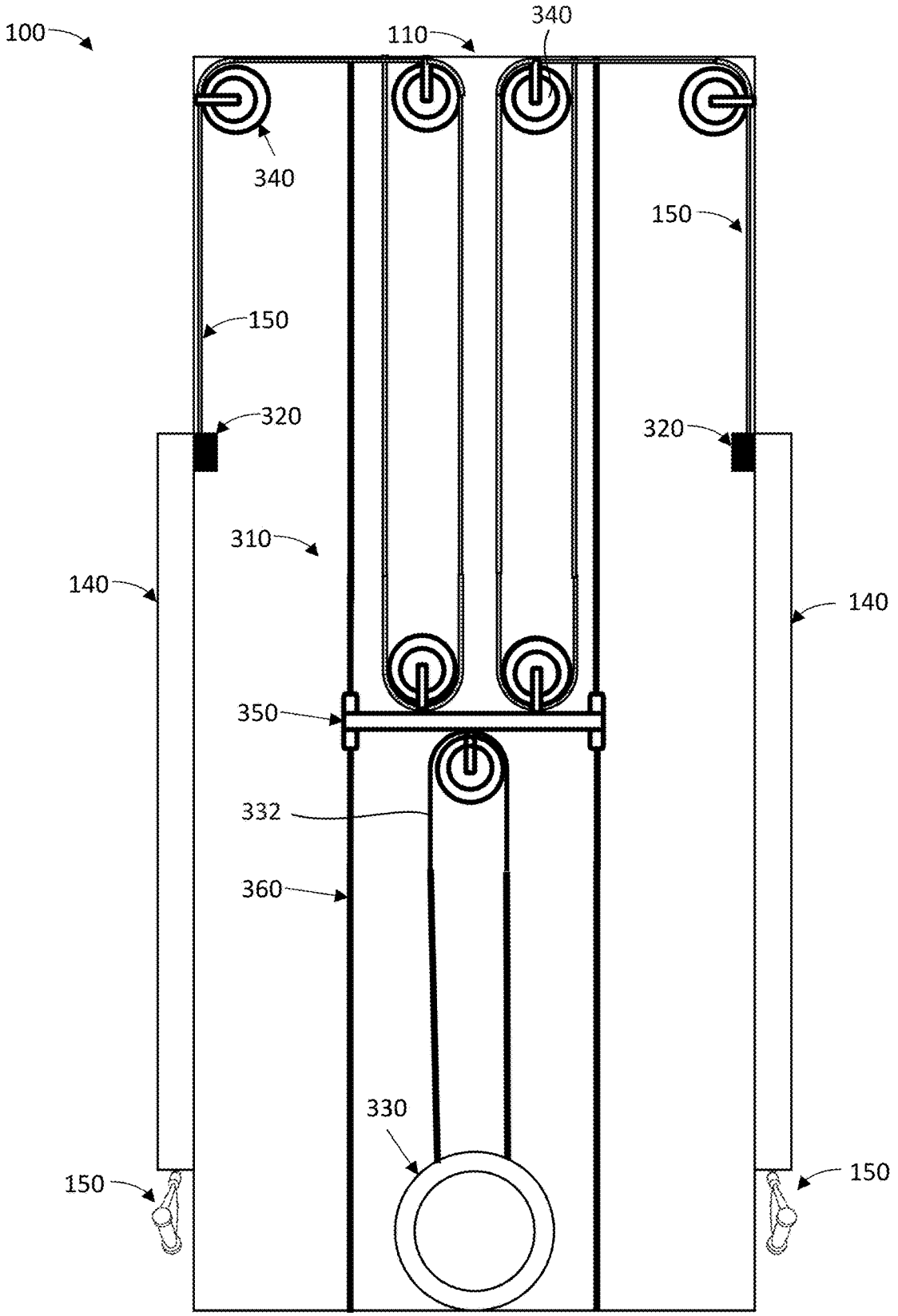
FIG. 3A is a back view of the exercise device of FIG. 1.

FIG. 3A is a back view of the exercise device 100 of FIG. 1. As discussed herein, the exercise device 100 includes a frame 110, one or more arms 140 rotatably and/or slidably connected to the frame, one or more arm motors 320 operatively coupled to the arms 140, and one or more pull cables 150 having handles 152.

In some embodiments, the exercise device includes a resistance mechanism 310. The resistance mechanism may include a carriage 350, one or more pulleys 340, and guide cables 360. The pull cables 150 may be operatively coupled with the carriage 350. For example, the pull cables 150 may each be configured with a first end fixed to the frame 110 and a second end disposed at a distal end of the arms 140 (e.g., connected to the handles 152). The pull cables 150 may engage one or more of the pulleys 340 such that a movement of the pull cables (e.g., pulling the pull cables) corresponds to a movement of the carriage 350. In some embodiments, the carriage 350 translates relative to the frame 110. For example, the carriage 350 may be slidably connected to the guide cables 360, and the carriage 350 may slide (e.g., vertically) along the guide cables 360. In this way, the guide cables 360 may guide and/or direct the movement of the carriage 350 in a vertical direction. In some embodiments, the movement of the pull cables 150 and the movement of the carriage 350 are proportional. For example, a length of the pull cables 150 pulled out of the arms 140 may correspond to a movement of the carriage 350 of the same length. In some embodiments, the movement of the pull cables 150 and a movement of the carriage 350 are not proportional. For example, a length of the pull cables 150 pulled out of the arms 140 may correspond to a movement of the carriage 350 of more or less than that length. This may correspond to a mechanical advantage of the pull cables 150 over the carriage 350, or a mechanical advantage of the carriage 350 over the pull cables 150. In this way, pulling on the pull cables 150 may result in a movement of the carriage 350.

In some embodiments, the resistance mechanism 310 includes a resistance motor 330. The resistance motor 330 may be coupled to the carriage 350, for example, by a lower cable 332. In some embodiments, the lower cable 332 is coupled to the carriage 350 and is wound around a shaft of the resistance motor 330 one or more times. A movement of the carriage 350 may cause the lower cable 332 to rotate the shaft of the resistance motor 330. In some embodiments, the resistance motor 330 is configured to resist the motion of the carriage 350. For example, an electrical energy input (e.g., an electrical current) may be applied to the resistance motor 330 such that a torque is applied to the shaft of the resistance motor 330 in a direction opposite the direction that the carriage 350 causes the shaft to rotate. In some embodiments, the exercise device 100 determines an amount of torque to apply based on a diameter of a spool of the lower cable 332 around the shaft of the resistance motor 330. In this way, the resistance motor 330 may provide a biasing force against the movement of the carriage 350. Put another way, an electrical current applied to the resistance motor 330 may, in one or more embodiment, bias the carriage 350 in a downward direction. In this way, a resistive force is applied to the pull cables 150 in order to facilitate one or more exercises.

In some embodiments, the resistance motor 330 is operably coupled to one or more sensors. The one or more sensors may be configured to sense a direction of rotation of the resistance motor 330 and a distance corresponding to the rotation of the resistance motor 330. For example, the one or more sensors may facilitate the exercise device 100 determining how far the pull cables 150 have been pulled and a direction of movement of the carriage 350 based on a rotation of the resistance motor 330. In some embodiments the one or more sensors are encoders. In some embodiments, the resistance motor 330 is an electric motor.

In some embodiments, the resistance motor 330 is configured to provide a variety of different types of resistance to the one or more pull cables 150. In some embodiments, the resistance motor 330 is configured to gradually increase or decrease an amount of resistance. In some embodiments the resistance motor 330 is configured to gradually increase or decrease an amount of resistance based on how far the pull cables 150 have been pulled. For example, an exercise simulating lifting chains may dictate increasing the resistance corresponding to a length that the pull cables 150 are pulled. In some embodiments the resistance motor 330 is configured to provide a constant resistance. For example, an exercise simulating lifting free weights may dictate a constant force through a movement of the pull cables 150. In some embodiments, the force may be changed or varied, such as to simulate free weights of different sizes or weights. In this way, the resistance motor 330 may simulate pulling against a weight stack of a conventional cable-driven exercise device. In some embodiments the resistance applied by the resistance motor 330 simulates an inertia and momentum of a weight stack using a speed of a user's motion and the weight of the simulated weight stack. In some embodiments, the resistance motor 330 provides a resistance based on a tension of the one or more pull cables 150. For example, the resistance motor 330 may be configured to maintain a constant tension on the one or more pull cables 150.

In some embodiments, the resistance motor 330 is configured to selectively provide concentric and/or eccentric loads to the movement of a user (e.g., to the user pulling or releasing the pull cables). In some embodiments, the resistance applied by the resistance motor 330 is constant for both concentric and eccentric movement. In some embodiments the resistance applied by the resistance motor 330 to resist concentric movement is different from the resistance applied by the resistance motor 330 to resist eccentric movement. For example, the resistance motor 330 may resist concentric movement with a force of 20 pounds and resist eccentric movement with a force of 40 pounds. In this way, a user may perform a concentric movement (e.g., contracting a muscle or muscle group) against a force that simulates a 20-pound weight and perform an eccentric movement (e.g., extending a muscle or muscle group) against a force that simulates a 40-pound weight stack as the user returns to an original position. This may facilitate exercises that focus on specific muscles and/or muscle groups.

In some embodiments, the resistance motor 330 is configured to decrease an applied resistance or cease applying a resistance based on a speed of movement of a user. For example, when the resistance motor 330 is applying eccentric force, the resistance motor 330 may cease applying the eccentric force if a speed of the resistance motor 330 exceeds a rate of rotation corresponding to threshold speed (e.g., 5 mph). In this way, the user may be protected from being injured by eccentric force that they cannot sufficiently resist by maintaining a lower speed on the resistance motor 330.

In some embodiments, the resistance motor 330 is configured to simulate an elastic band. For example, the resistance applied by the resistance motor 330 may increase as the pull cables 150 are pulled from the arms 140. The resistance applied by the resistance motor 330 may decrease as the pull cables 150 return. Put another way, as the lower cable 332 is pulled out from the spool around the shaft of the resistance motor 330, the resistance may increase, and as the lower cable 332 is spooled back onto the shaft of the resistance motor 330, the resistance may decrease. In this way, a user may experience an increasing concentric force and/or a decreasing eccentric force, simulating the force exerted by an elastic band. In some embodiments the resistance simulating an elastic band is proportional to the distance the one or more pull cables 150 are extended from the motor. In some embodiments the resistance simulating an elastic band is proportional to the square of the distance that the one or more pull cables 150 are extended.

In some embodiments, the resistance motor 330 is configured to vibrate the one or more pull cables 150, such as by providing a vibrating force. For example, the resistance motor 330 may vibrate one or more of the pull cables 150 to provide an indication to a user. The indication may correspond to one or more of a duration of time, a movement of a specific length, a segment of a workout, etc. In accordance to at least one embodiment of the preset disclosure, the resistance motor 330 provides a vibrating force to the one or more pull cables 150 during concentric and/or eccentric motion. This may indicate to the user which type of force is being applied to the pull cables 150 (e.g., eccentric or concentric). The vibrating force may be an oscillation in addition to a resistive force that the resistance motor 330 is applying to the one or pull cables 150. For example, the vibrating force may be produced by the resistance motor 330 rapidly rotating back and forth. In some embodiments, a frequency and/or range of the vibrating force may be adjustable by a user. The frequency of the vibrating force may be how quickly the resistance motor 330 rotates back and forth. The range of the vibrating force may be the amplitude of the oscillating rotations of the resistance motor 330, or how far the resistance motor 330 rotates during each period of the vibration.

Figure 3B:
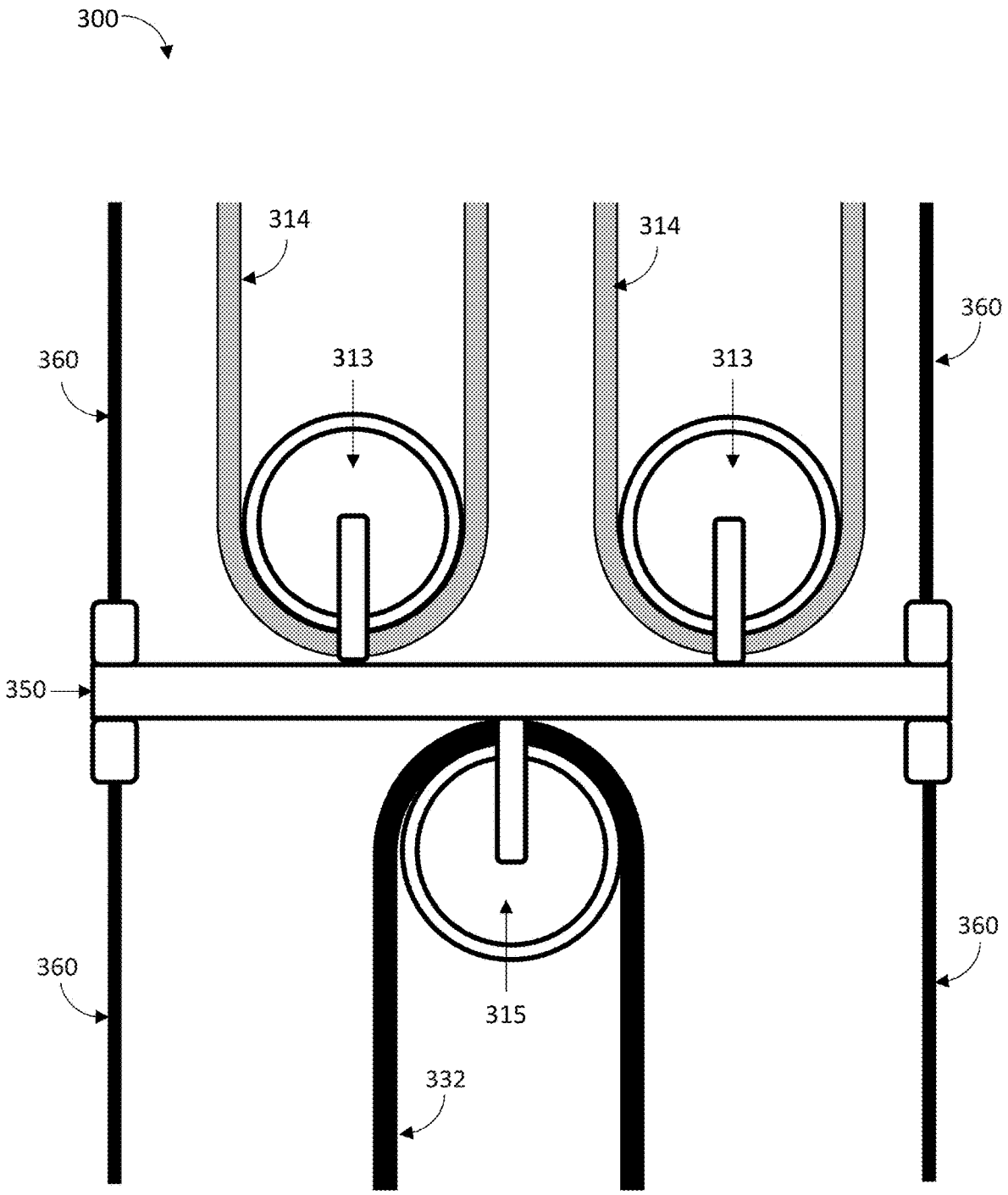
FIG. 3B is back view of a pulley system of the exercise device of FIG. 3A.

FIG. 3B illustrates a pulley system 300 of the exercise device 100 of FIG. 3A. The pulley system 300 may be part of the resistance mechanism 310 of FIG. 3A. In some embodiments, the pulley system 300 includes the carriage 350, the guide cables 360, one or more upper pulleys 313, one or more upper cables 314, one or more lower pulleys 315, and the lower cable 332. As discussed herein, the lower cable 332 may be operably coupled to the resistance motor 330 such that a resistance of the motor is transferred to the carriage 350. Movement of the carriage 350 may correspond to movement of the one or more upper cables 314 engaging with the one or more upper pulleys 313. In some embodiments the one or more upper cables 314 are the one or more pull cables 150. In some embodiments the one or more upper cables 314 are operably coupled to the one or more pull cables 150. The carriage 350 may be configured to travel (e.g., vertically) along the one or more guide cables 360. In some embodiments the carriage 350 may be pulled upwards by the upper cables (e.g., through a movement of the pull cables 150 by a user) and biased downwards by the lower cable 332 (e.g., by the resistance of the resistance motor).

In some embodiments the upper cables 314 and the lower cable 332 are the same type of cable or are made of the same material. In some embodiments, the upper cables 314 and the lower cable 332 may be different types of cables or may be made of different materials. For example, it may be desirable that the upper cables 314 have a higher elasticity in order that they return quickly after being pulled out of the arms and/or to provide a more comfortable user experience. Accordingly, the upper cables 314 may be at least partially made of rope or another material which has greater elastic properties than, for example, a steel cable. In some embodiments, there may be a greater amount of the upper cables 314 threaded through the pulley system 300 and out the arms 140. This may allow the upper cables 314 and/or the pull cables 150 to be pulled a much longer distance than the corresponding movement of the carriage 350. For example, the pulley system 300 may allow the one or more pull cables 150 to have a pull length from the one or more arms 140 of 2, 3, or 4 times longer than the movement of the carriage 350 (e.g., the length of cable which is unwound from the motor). It may desirable that the lower cable 316 have a higher tensile strength in order to transmit the resistive forces of the resistance motor 330 without breaking. Accordingly, the lower cable 332 may be a steel cable. In some embodiments, this allows a limited amount of the lower cable 316 to be spooled on the resistance motor 330. In this way, tangles and slips of the lower cable 316 may be avoided as the lower cable 316 winds and unwinds from the resistance motor 330. In this way, the pulley system 300 may facilitate transmitting the resistance of the resistance motor 330 to the pull cables 150 in order that a user might perform one or more exercises.

Figure 4:
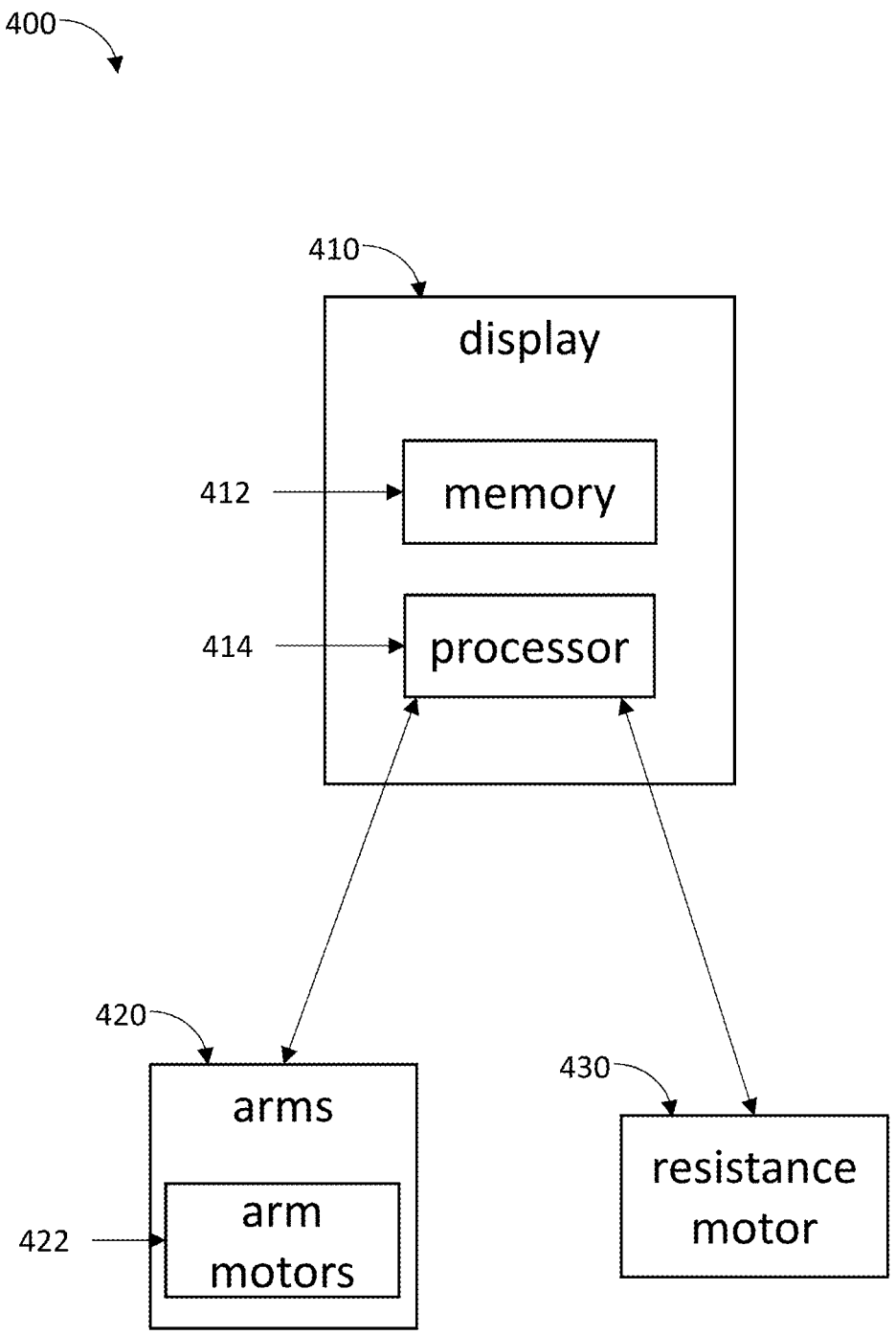
FIG. 4 is a block diagram of an exercise device, according to one embodiment of the present disclosure.

FIG. 4 is a block diagram of an exercise device 400, according to one embodiment of the present disclosure. The exercise device may include a display 410. The display may include a memory 412 and a processor 414. The processor 414 may send control signals to one or more arms 420 and/or a resistance motor 430. The one or more arms 420 may include arm motors 422. The memory 412 may store one or more workouts, each workout including a video and/or one or more control signals associated with exercises in the video. The display 410 may load a workout of the one or more workouts from the memory 412. The display 410 may display a video of the workout. The processor 414 may send control signals associated with exercises in the video to the resistance motor 430 and the arms 420. The resistance motor 430 may provide resistance based on the control signals associated with the exercises in the video. The arm motors 422 may one or more of raise, lower, and rotate the arms of the exercise device based on the control signals associated with the exercises in the video. In this way, the exercise device 400 may configure itself automatically by setting a resistance of the resistance motor 430 and/or a position of the one or more arms 420 according to the exercises in the workout. This allows a user of the exercise device 400 to exercise without having to configure the exercise device. In this way, the exercise device may be safer, more convenient, and more accurate than conventional exercise devices which do not configure themselves. In some embodiments a user may control movement of the arms 420 and/or resistance provided by the resistance motor 430 via user input at the display 410. The user may enter user input at a touchscreen of the display 410. The processor 414 may send control signals based on the user input to the arms 420 and/or the resistance motor 430. The user input may cause the arms 420 to move together or independently.

In some embodiments the processor 414 may track the arms 420 and halt movement of the arms 420 for safety. The processor 414 may receive data from the arm motors 422 about one or more of the location, direction of rotation, and speed of the arms 420. The processor 414 may determine one or more of an expected location, direction of rotation, and speed of the arms 420 based on the control signals the processor 414 sends to the arms 420. Each of the expected location, direction of rotation, and speed of the arms 420 may comprise a range of values. The processor 414 may compare each of the location, direction of rotation, and speed of the arms 420 to the expected location, direction of rotation, and speed of the arms. If they do not match, the processor 414 may send a control signal to the arms 420 to stop the arms. In some embodiments the processor 414 may monitor how much current is being drawn by the arm motors 422 and stop the arm motors 422 if the processor 414 detects a spike in the current being drawn by the arm motors 422.

The exercise device 400 as described herein in connection with FIG. 4 has been describe with respect to one or more particular components, systems, and subsystems described in relation to other components, systems, and subsystems. It should be understood, however, that an exercise device in accordance with the present disclosure may add to, omit, rearrange, and/or modify one or more of the components, systems, and subsystems of the block diagram of FIG. 4 in order to provide an exercise device as described herein.

Figure 5:
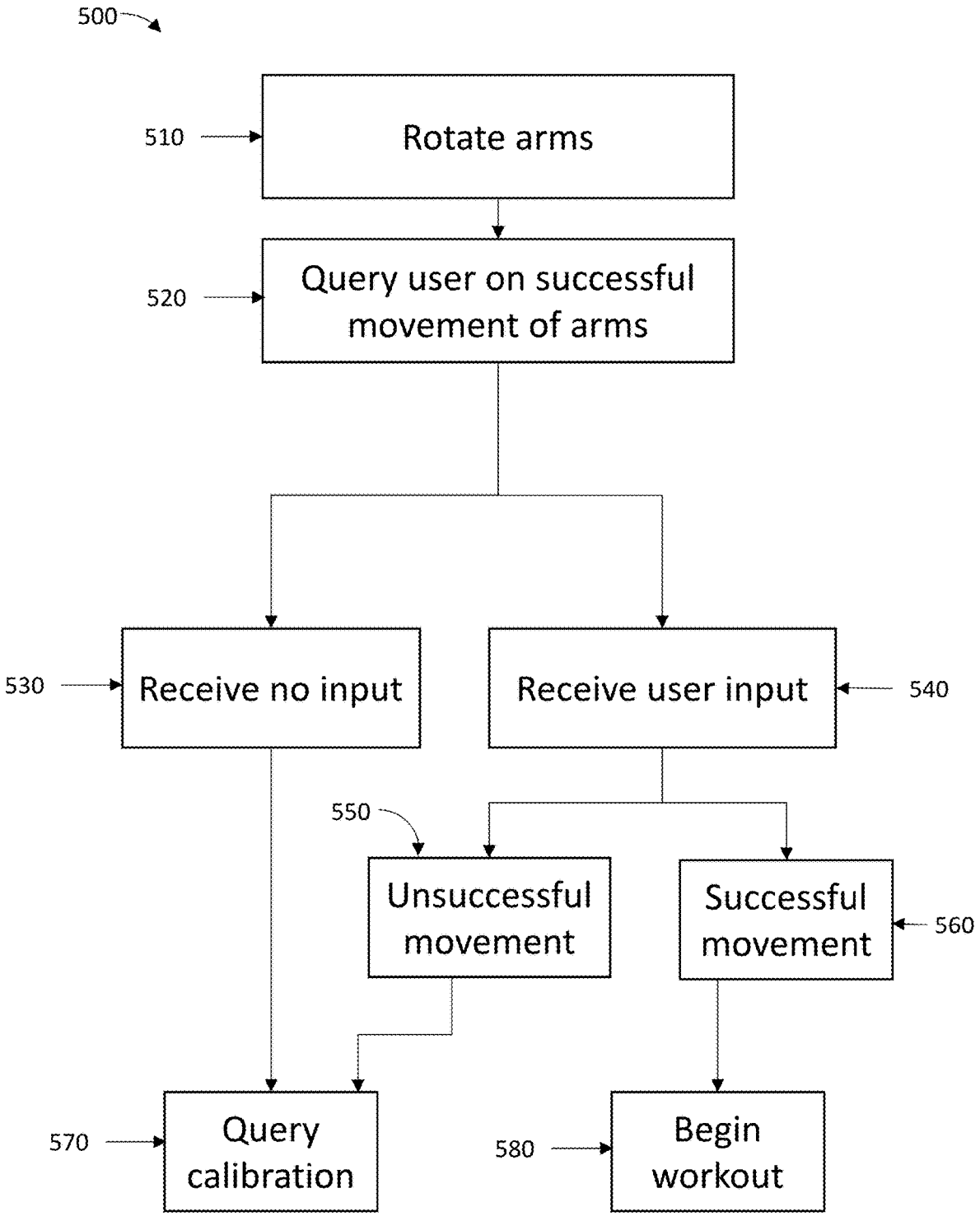
FIG. 5 is a flow diagram illustrating a method or series of acts for using an exercise device, according to one embodiment of the present disclosure.

FIG. 5 is a flow diagram illustrating a method 500 or a series of acts for using an exercise device as described herein, according to one embodiment of the present disclosure. While FIG. 5 illustrates acts according to one embodiment, alternative embodiments may omit, add to, reorder, and/or modify any of the acts shown in FIG. 5.

In some embodiments, the method 500 may include an act 510 of rotating one or more arms of an exercise device to a first position. In some embodiments, the arms may be rotated to the first position by one or more motors. In some embodiments, the one or more motors rotate the arms to the first position based on one or more control signals sent by a processor to the one or more motors. In some embodiments, the one or more motors include one or more sensors or encoders which track the rotation of the one or more motors. The one or more motors may send their position to the processor.

In some embodiments, the method 500 includes an act 520 of querying a user about the movement of the arms. For example, the processor may send a control signal to the one or more motors to move the arms to the first position, and the exercise device may query a user to determine whether the arms were successfully moved to the first position. The processor may cause a query to be displayed at a display of the exercise device. The display may be configured to receive user input. In some embodiments the display is a touchscreen. The user may respond to the query by entering a touch input at the display.

In some embodiments, the method 500 includes an act 530 of determining that no user input was received. For example, the exercise device may determine that an amount of time has passed since the user was queried and may determine that no input was received. In response to receiving no input (e.g., in response to an amount of passed time without an input), the method 500 may include an act 570 of querying calibration. For example, the exercise device may query the user on whether calibration should be performed. Querying calibration may include querying a memory of the exercise device on how much time has passed since the last calibration. In some embodiments the exercise device begins calibration of the one or more motors in response to one or more of receiving user input to perform calibration, an amount of time passing since querying a user about calibration, and/or an amount of time passing since the last calibration. In some embodiments, the processor sends a signal to the one or more motors to hold the arms in their current position.

In some embodiments, the method 500 includes an act 540 of determining that a user input was received. This may be in contrast, or as an alternative to act 530 of determining that no user input was received. In some embodiments, the user input is an indication that the movement of the arms was successful (e.g., act 560), or that the position of the arms matches what the exercise device has determined the expected position of the arms to be (e.g., that the arms were moved to the first position). In response to the movement of the arms being determined to be successful, in some embodiments the method 500 includes an act 580 of beginning a workout. For example, the exercise device may begin to display one or more images on a display of the exercise device associated with beginning an exercise for a user to perform, as discussed herein.

In some embodiments, the user input includes an indication that the movement of the arms was unsuccessful (e.g., act 550), corresponding to an indication that the position of the arms does not match what the processor has determined the expected position of the arms to be (e.g., that the arms were not moved to the first position). In response to the movement of the arms being determined to be unsuccessful, in some embodiments the method 500 proceeds to the act 570 of querying calibration, as described herein.

In some embodiments, the exercise device queries the user of the exercise device about a second position of one or more arms of the exercise device. For example, the exercise device may query the user on whether a second position of the one or more arms corresponds to a second expected position of the one or more arms. In some embodiments, the exercise device queries the user at a display of the exercise device.

In some embodiments, the exercise device receives a user input that the arms are in the correct position. For example, the user input may indicate that the second position of the one or more arms corresponds to the second expected position of the one more arms. In response to the user input, in some embodiments, the exercise device may begin exercise instruction.

In this way, the various acts of the method 500 may be performed to automatically move and/or verify the movement of the one or more arms of the exercise device resulting in improvements in safety.

Figure 6:
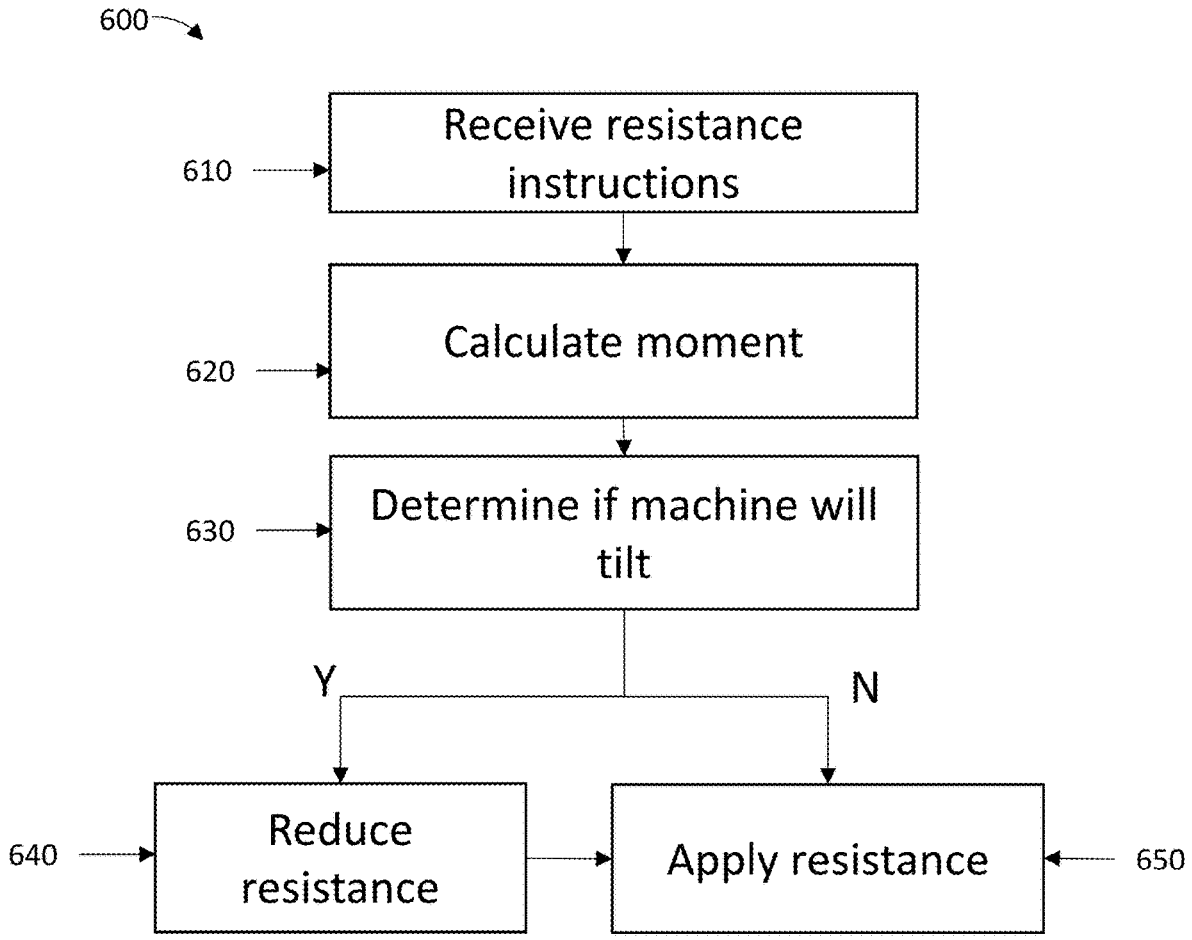
FIG. 6 is a flow diagram illustrating a method or series of acts for using an exercise device, according to one embodiment of the present disclosure.

FIG. 6 is a flow diagram illustrating a method 600 or a series of acts for using an exercise device as described herein, according to one embodiment of the present disclosure. While FIG. 6 illustrates acts according to one embodiment, alternative embodiments may omit, add to, reorder, and/or modify any of the acts shown in FIG. 6.

At 610, resistance instructions are received. The resistance instructions may include an amount of resistance, a vertical position of one or more arms of the exercise device, and/or a rotation of the one or more arms. The resistance instructions may also include a change of resistance and a change in position and rotation of the one or more arms, for example, during an exercise movement. The resistance instructions may include a type of exercise to be performed.

At 620, a moment (e.g., an applied force offset from an axis of rotation of the device at the floor) applied to the exercise device is calculated. The moment may be calculated based on an amount of force which will be applied to the exercise device, the location at which the force will be applied to the exercise device, and/or the expected direction of the force. The amount of force which will be applied to the exercise device may be based on the amount of resistance. In some embodiments, the location at which the force will be applied to the exercise device is based on the position and/or rotation of the one or more arms. The expected direction of the force may be based on the type of exercise to be performed and/or the position and/or rotation of the one or more arms.

At 630, the exercise device determines whether the exercise device will tilt (e.g., fall over). For example, the determination of whether the exercise device will tilt may be based on the calculated moment and/or one or more characteristics of the exercise device such as one or more of a weight of the exercise device, a center of mass of the exercise device, and a geometry of the exercise device. If it is determined that the exercise device will not tilt, at 650 a resistance is applied according to the resistance instructions. If it is determined that the exercise device will tilt, at 640 the amount of resistance may be reduced such that the exercise device will not tilt. A safe amount of resistance is then applied at 650. In some embodiments, the safe amount of resistance may incorporate a safety factor to determine an appropriate amount of resistance that can be applied to the exercise machine without making it tilt or fall over. In some embodiments, the exercise device alters and/or adjusts other parameters of the exercise device at 640. This may be in addition to, or in place of reducing the resistance. For example, the exercise device may alter parameters including the position of the one or more arms, the rotation of the one or more arms, any other parameter, and combinations thereof.

Other processes and mechanisms may be employed to prevent tilting of the exercise device. In some embodiments, the exercise device includes a tilt sensor for determining the orientation of the exercise device. In some embodiments, the tilt sensor is a 3-axis sensor, an accelerometer, and/or a gyroscope. The tilt sensor determines when a motion or orientation of the exercise device exceeds a predetermined threshold in order to determine that the exercise device is tilting. In some embodiments, the exercise device includes one or more strain gauges. The one or more strain gauges may detect when a component of the exercise device is under stress to determine that the exercise device is tilting or will tilt. For example, a strain gauge may be located on a supporting member of the exercise device. The strain gauge may measure stress or strain on the supporting member and determine that a force is being applied to the exercise device which may cause the exercise device to tilt.

The exercise device may alert a user when the exercise device is tilting or will tilt. The alert may take the form of an audible alarm, flashing lights, a message on the display, any other form, and combinations thereof. In some embodiments, the alert takes the form of a change in resistance applied to the one or more pull cables. In some embodiments, the alert takes the form of vibration applied to the one or more pull cables. For example, the exercise device may apply vibration to the one or more pull cables and emit an audible warning to warn the user that the exercise device is tilting or may tilt.

As described herein, the exercise device may reduce resistance applied to the one or more pull cables to prevent tipping. In some embodiments, the exercise device rapidly reduces the resistance. In some embodiments, the exercise device slowly reduces the resistance until the exercise device determines that it is not tipping. In some embodiments, the exercise device generally maintains the resistance while letting out the one or more pull cables in short bursts. In some embodiments, the exercise device gradually reduces the resistance on the one or more pull cables without losing tension in the one or more pull cables in a manner similar to the way an anti-lock braking system (ABS) gradually reduces a speed of a car on a road without losing grip on the road. In this way, the exercise device may prevent a tipping of the exercise device and/or alert a user to the tipping of the exercise device in order prevent injury to the user.

In an illustrative embodiment, any of the operations described herein can be implemented at least in part as computer-readable instructions stored on a computer-readable memory. Upon execution of the computer-readable instructions by a processor, the computer-readable instructions can cause a node to perform the operations.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "similar," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

INDUSTRIAL APPLICABILITY

Embodiments of the present disclosure are not limited by the above description. The example embodiments given are merely examples and do not limit the present disclosure. The example embodiments are provided in order to enable a person of ordinary skill in the art to implement the present disclosure. A person of ordinary skill in the art will understand additional embodiments and elements which logically descend from the example embodiments. Examples of such additional embodiments and elements as well as various modification to the device and methods above will now be disclosed.

The one or more arms of the exercise device may be curved. The one or more arms may curve inwards relative to the display or outwards relative to the display. The one or more arms may curve down relative to the display or up relative to the display. Each of the one or more arms may include more than one curve. The one or more arms may curve in the same direction or in opposite directions. A first arm of the one or more arms may be curved and a second arm of the one or more arms may be straight. The one or more arms may each include a hinge. The hinge may allow a second portion of each arm to extend in a different direction relative to a first portion of each arm which is attached to the frame. The one or more arms may be two arms located on opposite sides of the frame.

The frame may include one or more indicator lights. The indicator lights may show where the arms will move next. The indicator lights may flash when the arms are about to move. The indicator lights may indicate a direction of the movement of the arms. The indicator lights may indicate a pace of an exercise. The indicator lights may indicate an error status of the exercise device.

The frame may include a base. The base may comprise two legs which attach to the bottom of the frame. The two legs may be straight and may extend along the floor. The two legs may be attached to the bottom of the frame at a point about one-third along the length of the legs such that two-thirds of the legs extend in front of the exercise device. The two legs may be angled such that the ends of the legs nearly meet behind the exercise device and are located a much greater distance apart in front of the exercise device. The two legs may be angled such that they align with two arms of the exercise device when the two arms are extended in front of the exercise device. The frame may include one or more speakers. The one or more speakers may play audio of a workout video being displayed on the display of the exercise device.

The resistance mechanism of the exercise device may include a dump resistor. The dump resistor may be configured to absorb electric power generated by the motor when a user pulls on a pull cable. The resistance mechanism of the exercise device may include a battery configured to absorb electric power generated by the motor when a user pulls on a pull cable. The battery may be configured to direct power, for example, to the display of the exercise device.

The motor of the exercise device may be configured to provide a resistance of 85 pounds to each pull cable. The motor of the exercise device may provide a greater amount of resistance than is received by each pull cable. For example, the pulley system of the resistance mechanism may deliver half, a quarter, an eighth, or other proportion of the resistance produced by the motor to each pull cable. This may allow the pull cables to extend much farther than the distance of the cable connected to the motor.

The motor may be calibrated by unspooling the motor one quarter turn or another distance. The motor may include a mechanism for maintaining tension on the cable attached to the motor as the motor unspools. The mechanism may be an actuator which applies force to the cable in order to maintain tension in the cable.

The following examples are non-limiting.

A. An exercise device comprising:

a frame;

one or more processors;

a display disposed within the frame, the display including a mirrored surface and a backlit display behind the mirrored surface;

one or more arms extending from the frame;

one or more arm motors configured to raise and lower the arms relative to the frame;

one or more pull cables extending from the one or more arms; and a resistance mechanism including a motor configured to resist movement of the pull cables.

B. The exercise device of example A further comprising a second mirrored surface surrounding the display, the second mirrored surface disposed within the frame.

C. The exercise device of examples A or B wherein the one or more arms are rotatably attached to the frame.

D. The exercise device of any of examples A-C wherein the one or more arms are configured to rotate about a horizontal axis.

E. The exercise device of any of examples A-D wherein the one or more arms are configured to rotate about a vertical axis.

F. The exercise device of any of examples A-E wherein the one or more arms are angled outwards such that as the one or more arms are raised relative to the frame, a distance increases between a distal end of a first arm of the one or more arms and a distal end of a second arm of the one or more arms.

G. The exercise device of any of examples A-F further comprising one or more worm drives, wherein the one or more arm motors are operably coupled to the one or more arms using the one or more worm drives.

H. The exercise device of any of examples A-G wherein the one or more worm drives include one or more double enveloping worm gears.

I. The exercise device of any of examples A-H further comprising one or more cycloidal drives, wherein the one or more arm motors are operably coupled to the one or more arms using the one or more cycloidal drives.

J. The exercise device of any of examples A-I further comprising one or more harmonic drives, wherein the one or more arm motors are operably coupled to the one or more arms using the one or more harmonic drives.

K. The exercise device of any of examples A-J further comprising mechanical limit switches configured to halt movement of the one or more arms.

L. The exercise device of any of examples A-K wherein the one or more arm motors are configured to calibrate the movement of the one or more arms by rotating the one or more arms 180 degrees such that the arms engage one or more mechanical stops.

M. The exercise device of any of examples A-L wherein the motor is configured to vibrate the one or more pull cables.

N. The exercise device of any of examples A-M wherein the motor is configured to selectively provide concentric and eccentric force.

O. The exercise device of any of examples A-N further comprising one or more sensors operably coupled to the motor, the one or more sensors configured to determine a rotation of the motor.

P. The exercise device of any of examples A-O wherein the one or more sensors comprise encoders.

Q. The exercise device of any of examples A-P wherein the motor is configured to maintain a constant tension on the one or more pull cables.

R. The exercise device of any of examples A-Q wherein the resistance mechanism includes a traveling carriage, wherein one or more upper pulleys of the traveling carriage are operably connected to one or more ropes and wherein one or more lower pulleys of the traveling carriage are operably connected to one or more cables.

S. The exercise device of any of examples A-R wherein the one or more pull cables comprise one or more ropes.

T. The exercise device of any of examples A-S wherein the one or more pull cables are disposed within the one or more arms.

U. The exercise device of any of examples A-T wherein the mirrored surface allows a user to view themselves while exercising.

V. The exercise device of any of examples A-U wherein the display is not visible behind the mirrored surface when the display is turned off.

W. The exercise device of any of examples A-V wherein the display is a touchscreen.

X. The exercise device of any of examples A-W wherein the display is configured to receive user input.

Y. The exercise device of any of examples A-X wherein the one or more arms are configured to rotate up to 180°.

Z. The exercise device of any of examples A-Y wherein the one or more arms are configured to rotate at least 90°.

AA. The exercise device of any of examples A-Z wherein each of the one or more arms includes two pulleys at a distal end, wherein the two pulleys are disposed in a single plane and located proximate one another such that a pull cable of the one or more pull cables may pass between the two pulleys through grooves of the two pulleys but not move laterally out of the grooves of the two pulleys.

BB. The exercise device of any of examples A-AA wherein the display is configured to display a workout video and send control signals to the motor and the one or more arms according to exercise instructions in the workout video.

CC. A method comprising:

rotating one or more arms of an exercise device to a first position;

querying a user of the exercise device at a display of the exercise device on whether a position of the one or more arms corresponds to an expected position of the one or more arms;

determining that the position of the one or more arms does not correspond to an expected position of the one or more arms comprising:

determining that an amount of time has passed without receiving user input; or receiving user input indicating that the position of the one or more arms does not correspond to the expected position of the one or more arms; and beginning a calibration of the one or more arms.

DD. The method of example CC wherein the user input is received at a touchscreen of the display.

EE. The method of examples CC or DD wherein the user input comprises an indication of the position of the one or more arms.

FF. The method of examples CC-EE further comprising querying the user of the exercise device at the display of the exercise device on whether the calibration should be performed.

GG. The method of examples CC-FF further comprising querying the user of the exercise device at the display of the exercise device on whether a second position of the one or more arms corresponds to a second expected position of the one or more arms, receiving user input indicating that the second position of the one or more arms corresponds to the second expected position of the one or more arms and, in response to the user input, beginning exercise instruction.

HH. The exercise device of any of examples A-BB wherein the motor is configured to provide resistance to the one or more pull cables to simulate the resistance provided by a weight stack.

II. The exercise device of any of examples A-BB or HH wherein the motor is configured to provide resistance to the one or more pull cables to simulate the resistance provided by an elastic band.

JJ. The exercise device of any of examples A-BB or HH-II wherein the motor provides resistance and vibration to the one or more pull cables.

KK. The exercise device of any of examples A-BB or HH-JJ wherein the motor is configured to oscillate so as to vibrate the one or more pull cables.

LL. The exercise device of any of examples A-BB or HH-KK wherein the motor is configured to provide a first amount of resistance during concentric movements and a second amount of resistance during eccentric movements.

MM. The exercise device of any of examples A-BB or HH-LL wherein the motor is configured to decrease resistance in response to determining that a speed of movement of the motor exceeds a threshold speed.

NN. The exercise device of any of examples A-BB or HH-MM wherein the one or more arms are slidably attached to the frame.

OO. The exercise device of any of examples A-BB or HH-NN wherein the one or more arms are slidably attached to one or more rails of the frame.

PP. The exercise device of any of examples A-BB or HH-OO wherein the one or more arms are configured to travel vertically along the frame.

QQ. The exercise device of any of examples A-BB or HH-PP wherein the one or more arms are configured to be located at a first position at the bottom of the frame, a second position at the top of the frame, or any position between the first position and the second position.

RR. The exercise device of any of examples A-BB or HH-QQ wherein the one or more arms are configured to travel vertically along the frame using one or more additional arm motors.

SS. The exercise device of any of examples A-BB or HH-RR wherein the one or more arms are configured to travel vertically along the frame using a rack and pinion mechanism.

TT. The exercise device of any of examples A-BB or HH-SS wherein the one or more arms are configured to be fixed in place by gripping one or more rails of the frame.

UU. The exercise device of any of examples A-BB or HH-TT wherein the one or more processors are configured to:

receive resistance instructions;

calculate a moment applied to the exercise device;

determine whether the exercise device will tilt; and in response to determining whether the exercise device will tilt, applying an amount of resistance to the one or more pull cables such that the exercise device will not tilt.

VV. The exercise device of any of examples A-BB or HH-UU further comprising a tilt sensor configured to determine whether the exercise device is tilting or will tilt.

WW. The exercise device of any of examples A-BB or HH-VV wherein the motor is configured to reduce the resistance applied to the one or more pull cables in response to determining that the exercise device is tilting or will tilt.

XX. The exercise device of any of examples A-BB or HH-WW wherein the motor is configured to apply vibration to the one or more pull cables in response to determining that the exercise device is tilting or will tilt.

YY. A method comprising:

receiving resistance instructions for an exercise device;

calculating a moment applied to the exercise device;

determining whether the exercise device will tilt; and in response to determining whether the exercise device will tilt, applying an amount of resistance to the one or more pull cables such that the exercise device will not tilt.

What is claimed is:

1. An exercise device comprising:

a frame;

a mirrored surface connected to the frame;

a display disposed within the frame and positioned such that the display is viewable through at least a portion of the mirrored surface;

one or more arm motors attached to the frame;

one or more arms operably connected to the one or more arm motors;

one or more pull cables extending from the one or more arms; and a resistance mechanism comprising a motor configured to resist movement of the one or more pull cables, the resistance mechanism further comprising:

a traveling carriage, one or more upper pulleys mounted to an upper portion of the traveling carriage, and one or more lower pulleys mounted to a lower portion of the traveling carriage, wherein the traveling carriage is operably coupled with the one or more pull cables via the one or more upper pulleys, wherein the one or more upper pulleys are operably connected to the one or more pull cables, and wherein the one or more lower pulleys are operably connected to one or more cables that are operably connected to the motor.

2. The exercise device of claim 1, wherein the mirrored surface includes a first portion and a second portion surrounding the first portion, and wherein the display is positioned such that it is viewable through the first portion.

3. The exercise device of claim 1, wherein the motor is configured to vibrate the one or more pull cables.

4. The exercise device of claim 1, wherein the motor is configured to selectively provide concentric and eccentric force.

5. The exercise device of claim 1, further comprising:

one or more sensors operably coupled to the motor, the one or more sensors configured to determine a rotation of the motor.

6. The exercise device of claim 1, wherein the motor is configured to maintain a constant tension on the one or more pull cables.

7. The exercise device of claim 1, wherein the one or more pull cables comprise one or more ropes disposed within the one or more arms.

* * * * *